US011295719B2

(12) United States Patent
He

(10) Patent No.: US 11,295,719 B2
(45) Date of Patent: Apr. 5, 2022

(54) SOUND RECEIVING APPARATUS AND METHOD

(71) Applicant: REALTEK SEMICONDUCTOR CORPORATION, Hsinchu (TW)

(72) Inventor: Wei-Hung He, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/074,659

(22) Filed: Oct. 20, 2020

(65) Prior Publication Data

US 2021/0125599 A1 Apr. 29, 2021

(30) Foreign Application Priority Data

Oct. 24, 2019 (TW) ..... 108138433

(51) Int. Cl.
*H04R 3/00* (2006.01)
*G10K 11/178* (2006.01)
(Continued)

(52) U.S. Cl.
CPC ..... *G10K 11/17885* (2018.01); *G10K 11/24* (2013.01); *G10L 21/02* (2013.01);
(Continued)

(58) Field of Classification Search
CPC . H04R 3/005; H04R 2460/13; H04R 2430/03
See application file for complete search history.

(56) References Cited

U.S. PATENT DOCUMENTS 8,204,252 B1 * 6/2012 Avendano ..... H04R 5/027 381/94.7
9,812,147 B2 11/2017 Kechichian et al.
(Continued)

FOREIGN PATENT DOCUMENTS

CN 103229238 B 7/2015
CN 105245990 A 1/2016

OTHER PUBLICATIONS

OA letter of the counterpart TW application (appl No. 108138433 ) dated Nov. 10, 2020. Summary of the OA letter: Claims 1~10 are rejected as being unpatentable over the disclosure of the cited reference 1 (CN 103229238 B, also published as U.S. Pat. No. 9,812,147 B2) and the cited reference 2 (CN 105245990 A).
(Continued)

*Primary Examiner* — Ping Lee
(74) *Attorney, Agent, or Firm* — WPAT, PC

(57) ABSTRACT

The present disclosure discloses a sound receiving that includes an air conduction sound receiving circuit, a bone conduction sound receiving circuit, an adaptive filter, a crossover frequency control circuit and a synthesis circuit. The air conduction sound receiving circuit generates an air conduction sound signal. The bone conduction sound receiving circuit generates a bone conduction sound signal. The adaptive filter performs calculation according to a minimum of an error function in real time to generate a transferring filter function to filter the bone conduction sound signal to generate a transferred bone conduction sound signal. The crossover frequency control circuit determines a crossover frequency according to a maximum energy frequency point of the transferring filter function on a frequency domain. The synthesis circuit synthesizes the air conduction sound signal higher than the crossover frequency and the bone conduction sound signal lower than the crossover frequency to generate a synthesized sound signal.

16 Claims, 4 Drawing Sheets

(51) Int. Cl.

| | |
|---|---|
| ***G10L 21/0232*** | (2013.01) |
| ***G10K 11/24*** | (2006.01) |
| ***G10L 21/02*** | (2013.01) |
| ***H04R 3/04*** | (2006.01) |

(52) U.S. Cl.
CPC ..... *G10L 21/0232* (2013.01); *H04R 3/00* (2013.01); *H04R 3/005* (2013.01); *H04R 3/04* (2013.01); *G10K 2210/3028* (2013.01); *H04R 2430/03* (2013.01); *H04R 2460/13* (2013.01)

(56) References Cited

U.S. PATENT DOCUMENTS

| | | | | |
|---|---|---|---|---|
| 10,037,753 | B2 | 7/2018 | Hui et al. | |
| 2012/0278070 | A1* | 11/2012 | Herve ..... | G10L 21/0208 704/226 |

OTHER PUBLICATIONS

Ho Seon Shin et al., "Survey of Speech Enhancement Supported by a Bone Conduction Microphone", Jan. 2012, Conference Paper, Paper10_ITG_Fachtagung_Sprachkommunikation_2012.

Kazuhiro Kondo et al., "On Equalization of Bone Conducted Speech for Improved Speech Quality", 2006, pp. 426-431, IEEE International Symposium on Signal Processing and Information Technology, isspit2006.

* cited by examiner

SOUND RECEIVING APPARATUS AND METHOD

BACKGROUND OF THE INVENTION

1. Field of the Invention

The present disclosure relates to a sound receiving apparatus and a sound receiving method.

2. Description of Related Art

When a user use an earphone put on a head or put into the ears to perform communication, a sound receiving apparatus is implemented by using a microphone disposed in the earphone. In order to avoid the interference of environment noises, a bone conduction microphone can be equipped in the earphone to receive the signal transmitted through the vibration of bones and skins when the user is speaking. The environment noises are not easily transmitted to the bone conduction microphone through vibration. As a result, the bone conduction microphone is able to output a voice signal having a high signal to noise ratio.

However, the bone conduction microphone has a drawback of serious attenuation in high frequency. On the other hand, the low frequency part of the signal received by the bone conduction microphone may have lots of noises (e.g. due to the influence of gravity). When only the bone conduction microphone is used, the quality of the voice signal may not be ideal.

SUMMARY OF THE INVENTION

In consideration of the problem of the prior art, an object of the present disclosure is to provide a sound receiving apparatus and a sound receiving method.

The present disclosure discloses a sound receiving apparatus that includes an air conduction sound receiving circuit, a bone conduction sound receiving circuit, an adaptive filter, a crossover frequency control circuit and a synthesis circuit. The air conduction sound receiving circuit is configured to generate an air conduction sound signal according to a sound. The bone conduction sound receiving circuit is configured to generate a bone conduction sound signal according to the sound. The adaptive filter is configured to perform calculation according to a minimum of an error function in real time to generate a transferring filter function to filter the bone conduction sound signal and generate a transferred bone conduction sound signal, in which the error function is an error between the air conduction sound signal and the transferred bone conduction sound signal. The crossover frequency control circuit is configured to determine a crossover frequency according to a maximum energy frequency point of the transferring filter function on a frequency domain. The synthesis circuit is configured to synthesize a part of the air conduction sound signal that is higher than the crossover frequency and a part of the bone conduction sound signal that is lower than the crossover frequency to generate a synthesized sound signal.

The present disclosure also discloses a sound receiving method used in a sound receiving apparatus that includes the steps outlined below. An air conduction sound signal is generated according to a sound by an air conduction sound receiving circuit. A bone conduction sound signal is generated according to the sound by a bone conduction sound receiving circuit. Calculation is performed by an adaptive filter according to a minimum of an error function in real time to generate a transferring filter function to filter the bone conduction sound signal and generate a transferred bone conduction sound signal, in which the error function is an error between the air conduction sound signal and the transferred bone conduction sound signal. A crossover frequency is determined by a crossover frequency control circuit according to a maximum energy frequency point of the transferring filter function on a frequency domain. A part of the air conduction sound signal that is higher than the crossover frequency and a part of the bone conduction sound signal that is lower than the crossover frequency are synthesized to generate a synthesized sound signal by a synthesis circuit.

These and other objectives of the present disclosure will no doubt become obvious to those of ordinary skill in the art after reading the following detailed description of the preferred embodiments that are illustrated in the various figures and drawings.

DETAILED DESCRIPTION OF THE PREFERRED EMBODIMENTS

An aspect of the present invention is to provide a sound receiving apparatus and a sound receiving method to dynamically adjust the crossover frequency that separates the frequency domains to combine the sound receiving results from the sound receiving circuits having different frequency characteristics. A better and strongly adaptive sound receiving result can be obtained.

Figure 1A:
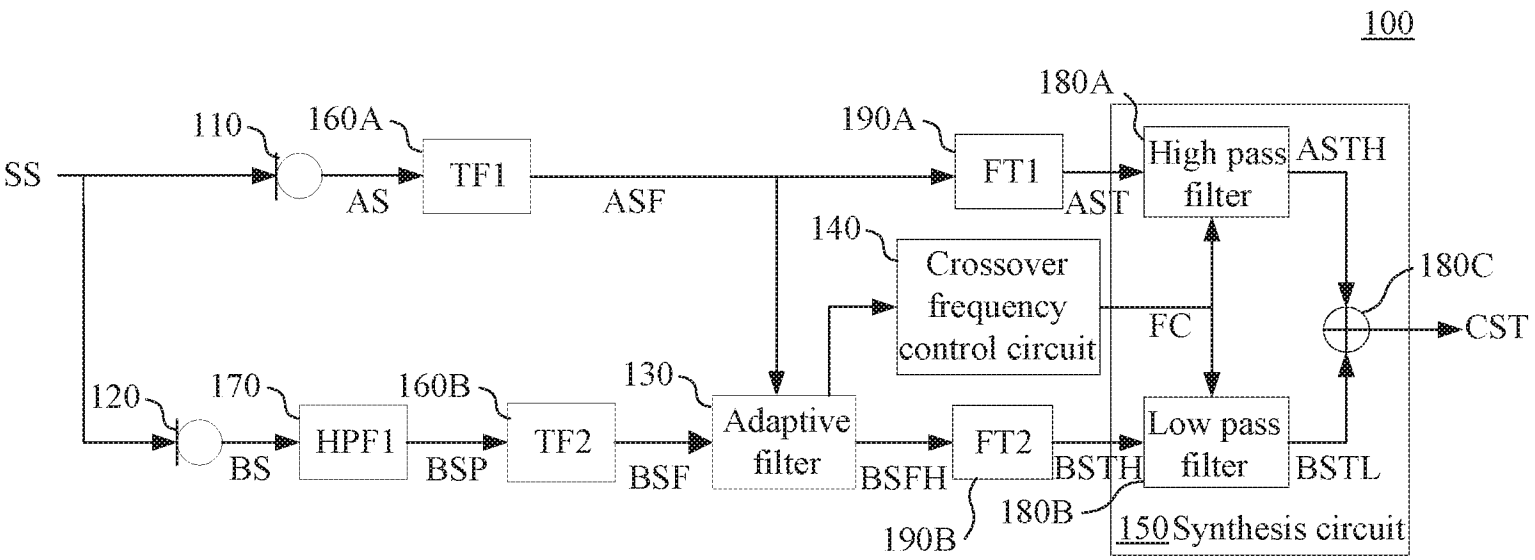
FIG. 1A illustrates a block diagram of a sound receiving apparatus according to an embodiment of the present invention.

Reference is now made to FIG. 1A. FIG. 1A illustrates a block diagram of a sound receiving apparatus 100 according to an embodiment of the present invention. The sound receiving apparatus 100 includes an air conduction sound receiving circuit 110, a bone conduction sound receiving circuit 120, an adaptive filter 130, a crossover frequency control circuit 140 and a synthesis circuit 150.

The air conduction sound receiving circuit 110 is configured to generate an air conduction sound signal AS according to a sound SS. In an embodiment, the air conduction sound receiving circuit 110 is a microphone that generates the air conduction sound signal AS according to such as, but not limited the vibration of the sound SS in the air.

The bone conduction sound receiving circuit 120 is configured to generate a bone conduction sound signal BS according to the sound SS. In an embodiment, the bone conduction sound receiving circuit 120 is a G-sensor and is configured to touch a portion of the body of a user, such as but not limited to the head thereof, to generate the bone conduction sound signal BS according to the vibration of the sound generated from the bones.

In an embodiment, in order to provide a better operation for the other components of the sound receiving apparatus 100, the sound receiving apparatus 100 may further include a first time domain to frequency domain conversion circuit 160A (labeled as TF1 in FIG. 1A), a second time domain to frequency domain conversion circuit 160B (labeled as TF2 in FIG. 1A) and a pre-processing high pass filter 170 (labeled as HPF1 in FIG. 1A).

The first time domain to frequency domain conversion circuit 160A is configured to perform a time domain to frequency domain conversion on the air conduction sound signal AS received by the air conduction sound receiving circuit 110 to generate an air conduction sound signal ASF on the frequency domain. Identically, the second time domain to frequency domain conversion circuit 160B is configured to perform a time domain to frequency domain conversion on the bone conduction sound signal BS received by the bone conduction sound receiving circuit 120 to generate a bone conduction sound signal BSF on the frequency domain.

In an embodiment, since the bone conduction sound receiving circuit 120 easily suffers from the interference of noises during the low frequency range, a high pass filtering can be performed on the bone conduction sound signal BS by using the pre-processing high pass filter 170 to generate a bone conduction sound signal BSP. The second time domain to frequency domain conversion circuit 160B substantially performs the time domain to frequency domain conversion on the bone conduction sound signal BSP. In an embodiment, the pre-processing high pass filter 170 filters out the components of the bone conduction sound signal BS having the frequency lower than X Hz (i.e. 0~X Hz). In an embodiment, X can be such as, but not limited to 50 Hz to 90 Hz.

The adaptive filter 130 is configured to perform calculation according to a minimum of an error function in real time to generate a transferring filter function Hinv (n,f) to filter the bone conduction sound signal BSF and generate a transferred bone conduction sound signal BSFH. By using the transferring operation of the transferring filter function Hinv (n,f), the amplitude and the phase of the transferred bone conduction sound signal BSFH can be close to those of the air conduction sound signal ASF such that the best synthesis result can be obtained subsequently.

In an embodiment, the error function is an error E (n,f) between the air conduction sound signal ASF and the transferred bone conduction sound signal BSFH. Since the transferred bone conduction sound signal BSFH is the multiplication result of the bone conduction sound signal BSF and the transferring filter function Hinv (n,f), under the condition that the air conduction sound signal ASF and the bone conduction sound signal BSF are represented as ASF (n,f). BSF (n,f), which are functions of time and frequency, the error E (n,f) can be expressed by the following equation:

$$E(n,f)=ASF(n,f)-Hinv(n,f)\times BSF(n,f) \quad \text{(equation 1)}$$

In the equation described above, n represents the time spot, f represents the frequency, in which n is an integer larger than or equal to 0 and f is a positive number larger than or equal to 0.

In an embodiment, the error function is the least mean square error function of the error E (n,f) and is represented by the following equation:

$$E[|E(n,f)|^2]=E[|ASF(n,f)-Hinv(n,f)\times BSF(n,f)|^2] \quad \text{(equation 2)}$$

In an embodiment, the transferring filter function Hinv (n,f) is generated by such as, but not limited to a normalized least mean square (NLMS) algorithm such that the equation 2 has a minimum value. The generated transferring filter function Hinv (n,f) can be expressed by the following equation:

$$Hinv(n,f)=Hinv(n-1,f)+(\mu/IBSF(n-1,f)|^2)\times BSF(n-1,f)\times E^*(n-1,f)$$

In the equation described above, p is an adjustable parameter that determines a convergence speed and E*(n,f) is a conjugated result of the error E (n,f).

It is appreciated that the error function and the method to obtain the transferring filter function using the minimum value of the error function described above are merely an example. In other embodiments, other functions can be used to represent the error and the transferring filter function can be obtained by using other calculation methods.

The crossover frequency control circuit 140 is configured to determine a crossover frequency FC according to a maximum energy frequency point of the transferring filter function Hinv (n,f) on the frequency domain.

In an embodiment, the crossover frequency control circuit 140 determines the maximum energy frequency point of the transferring filter function Hinv (n,f) on the frequency domain by using the following equation:

$$\text{peak}(n)=arg\ \max\{|Hinv(n,f)|^2\} \quad \text{(equation 3)}$$

In an embodiment, the frequency corresponding to the maximum energy frequency point may not be the best choice for the crossover frequency FC. As a result, the crossover frequency control circuit 140 may determine the crossover frequency FC by perform calculation on the frequency of the maximum energy frequency point by using at least one adjusting function and/or an average function.

Take an adjusting function ps(n) as an example, the crossover frequency control circuit 140 can perform calculation by using fine-tuning parameters:

$$ps(n)=\text{peak}(n)\times a+b \quad \text{(equation 4)}$$

In the equation described above, a and b are the fine-tuning parameters that can be either an integer or a non-integer.

Take an average function as an example, the crossover frequency control circuit 140 can perform calculation on the adjusting function ps(n) described above and the crossover frequency FC to determine a current crossover frequency FC (n) at a time spot n:

$$FC(n)=FC(n-1)\times\alpha+ps(n)\times(1-\alpha) \quad \text{(equation 5)}$$

In an embodiment, a is an adjustable parameter that varies along with such as, but not limited to the intensity of the signal or the characteristic of the transferring filter function Hinv (n,f). Besides, in an embodiment, due to the effective frequency bandwidth and the characteristic of the channel of the bone conduction sound receiving circuit 120, a lower limit of 500 Hz and an upper limit of 2000 Hz can be set for adjusting of the crossover frequency FC (n). The value of the crossover frequency FC (n) cannot be further adjusted to be larger or lower when the value of the crossover frequency FC (n) reaches the upper limit or the lower limit.

It is appreciated that the determination of the crossover frequency FC performed by the crossover frequency control circuit 140 described above is merely an example. In other embodiments, the crossover frequency control circuit 140 can adjust the maximum energy frequency point by using other adjusting functions or perform averaging on different crossover frequencies FC corresponding to neighboring time spots by using other functions. The present invention is not limited thereto.

The synthesis circuit 150 is configured to synthesize a part of the air conduction sound signal ASF that is higher than the crossover frequency FC and a part of the transferred bone conduction sound signal BSFH that is lower than the crossover frequency FC to generate a synthesized sound signal CST.

In an embodiment, the synthesis circuit 150 includes a high pass filter 180A, a low pass filter 180B and an adding circuit 180C.

Figure 1B:
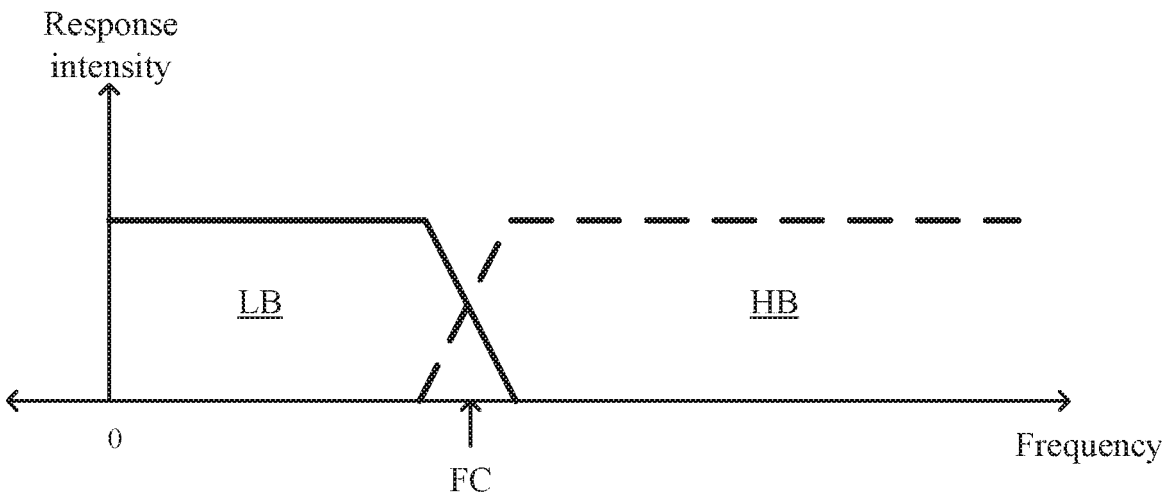
FIG. 1B is a diagram illustrating the frequency response of the high pass filter and the low pass filter according to an embodiment of the present invention.

Reference is now made to FIG. 1B at the same time. FIG. 1B is a diagram illustrating the frequency response of the high pass filter 180A and the low pass filter 180B according to an embodiment of the present invention. The X-axis represents the frequency and the Y-axis represents the response intensity.

The high pass filter 180A is configured to perform a high pass filtering on the air conduction sound signal ASF according to a high frequency band HB higher than the crossover frequency FC to generate a first filtered result ASTH. The low pass filter 180B is configured to perform a low pass filtering on the transferred bone conduction sound signal BSFH according to a low frequency band LB lower than the crossover frequency FC to generate a second filtered result BSTL.

In practical implementation, though the cut off frequency set by the high pass filter 180A and the low pass filter 180B is the crossover frequency FC, the frequencies of the signals that the high frequency band HB and the low frequency band LB allow to pass may be overlapped in a certain degree, in which the total response of the high frequency band HB and the low frequency band LB is preferably a flat surface. More specifically, the total response of the high frequency band HB and the low frequency band LB is ideally close to an all-past band.

Subsequently, the adding circuit 180C is configured to add the first filtered result ASTH and the second filtered result BSTL to generate the synthesized sound signal CST.

In an embodiment, the sound receiving apparatus 100 further includes a first frequency domain to time domain conversion circuit 190A (labeled as FT1 in FIG. 1A) and a second frequency domain to time domain conversion circuit 190B (labeled as FT2 in FIG. 1A).

The first frequency domain to time domain conversion circuit 190A is configured to perform a frequency domain to time domain conversion on the air conduction sound signal ASF converted to the frequency domain to generate an air conduction sound signal AST to be further filtered by the high pass filter 180A. The second frequency domain to time domain conversion circuit 190B is configured to perform a frequency domain to time domain conversion on the transferred bone conduction sound signal BSFH converted to the frequency domain to generate a transferred bone conduction sound signal BSTH to be filtered by the low pass filter 180B. Under such a condition, the synthesis circuit 150 operates on a time domain. The synthesized sound signal CST generated therefrom is also on the time domain.

Figure 2:
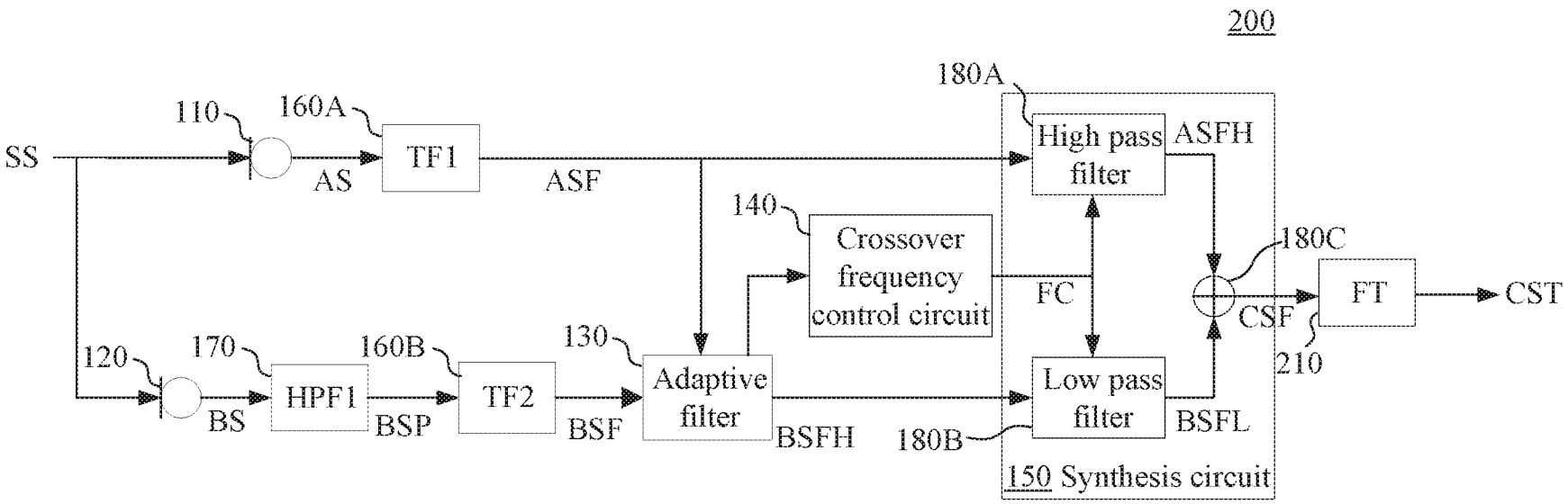
FIG. 2 is a block diagram of a sound receiving apparatus according to an embodiment of the present invention.

Reference is now made to FIG. 2. FIG. 2 is a block diagram of a sound receiving apparatus 200 according to an embodiment of the present invention.

The components included in the sound receiving apparatus 200 are actually identical to the components included in the sound receiving apparatus 100 in FIG. 1A, in which the components include the air conduction sound receiving circuit 110, the bone conduction sound receiving circuit 120, the adaptive filter 130, the crossover frequency control circuit 140 and the synthesis circuit 150.

However, in the present embodiment, the high pass filter 180A and the low pass filter 180B included in the synthesis circuit 150 directly receive the air conduction sound signal ASF and the transferred bone conduction sound signal BSFH on the frequency domain respectively to perform filtering thereon such that the adding circuit 180C adds the filtered results to generate a synthesized sound signal CSF.

The sound receiving device 200 further includes a frequency domain to time domain conversion circuit 210 (labeled as FT in FIG. 2). The frequency domain to time domain conversion circuit 210 is configured to perform a frequency domain to time domain conversion on the synthesized sound signal CSF to generate the synthesized sound signal CST on the time domain. Under such a condition, the synthesis circuit 150 operates on the frequency domain.

In other embodiments, the sound receiving device 100 may also dispose a frequency domain to time domain conversion circuit between the high pass filter 180A and the adding circuit 180C of the synthesis circuit 150 and dispose another frequency domain to time domain conversion circuit between the low pass filter 180B and the adding circuit 180C of the synthesis circuit 150. Under such a condition, the high pass filter 180A and the low pass filter 180B operate on the frequency domain and the adding circuit 180C operates on the time domain.

As a result, the sound receiving device 100 of the present invention can combine the high frequency components of the sound receiving result of the air conduction sound receiving circuit 110 and the low frequency components of the sound receiving result of the bone conduction sound receiving circuit 120 to generate the synthesized sound signal CST such that different characteristics of different sound receiving circuits can be used at the same time to accomplish the best sound receiving result. Further, the crossover frequency CF that separates the high frequency range and the low frequency range can be adjusted dynamically in real time to be adaptive to different transmission characteristics and different wearing positions of different users.

Figure 3:
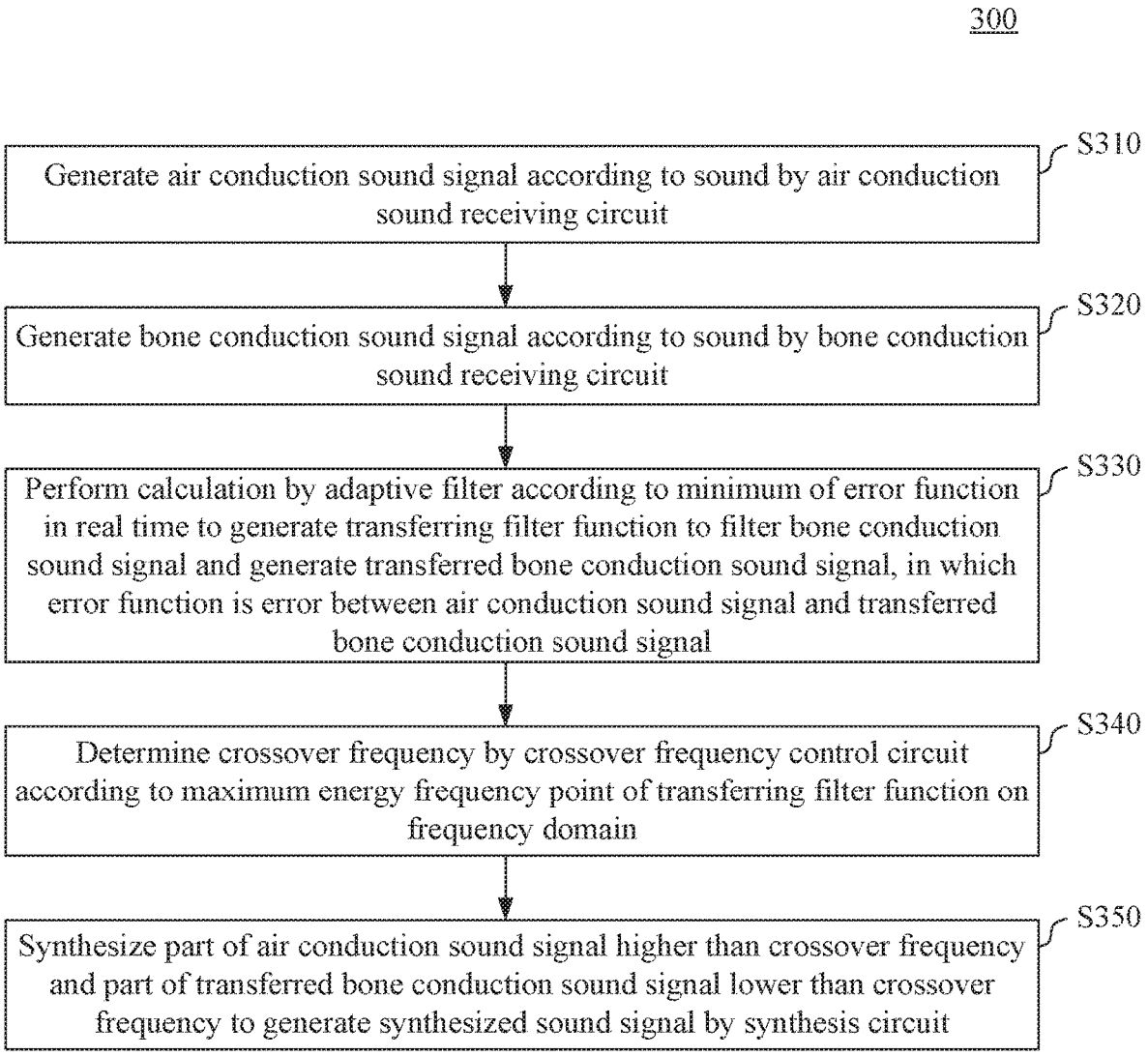
FIG. 3 illustrates a flow chart of a sound receiving method according to an embodiment of the present invention.

FIG. 3 illustrates a flow chart of a sound receiving method 300 according to an embodiment of the present invention.

Besides the device described above, the present invention further provides the sound receiving method 300 that can be used in such as, but not limited to the sound receiving apparatus 100 in FIG. 1A or the sound receiving apparatus 200 in FIG. 2. As illustrated in FIG. 3, an embodiment of the sound receiving method 300 includes the following steps.

In step S310, the air conduction sound signal AS is generated according to the sound SS by the air conduction sound receiving circuit 110.

In step S320, the bone conduction sound signal BS is generated according to the sound SS by the bone conduction sound receiving circuit 120.

In an embodiment, the air conduction sound signal AS and the bone conduction sound signal BS can be processed by the first time domain to frequency domain conversion circuit 160A and the second time domain to frequency domain conversion circuit 160B respectively to generate the air conduction sound signal ASF and the bone conduction sound signal BSF on the frequency domain.

In step S330, the calculation is performed by the adaptive filter 130 according to the minimum of the error function in real time to generate the transferring filter function Hinv (n,f) to filter the bone conduction sound signal BSF and generate the transferred bone conduction sound signal BSFH, in which the error function is the error between the air conduction sound signal ASF and the transferred bone conduction sound signal BSFH.

In step S340, the crossover frequency FC is determined by the crossover frequency control circuit 140 according to the maximum energy frequency point of the transferring filter function Hinv (n,f) on the frequency domain.

In an embodiment, the air conduction sound signal ASF and the bone conduction sound signal BSF can be processed by the first frequency domain to time domain conversion circuit 190A and the second frequency domain to time domain conversion circuit 190B respectively to generate the air conduction sound signal AST and the transferred bone conduction sound signal BSTH.

In step S350, the part of the air conduction sound signal AST that is higher than the crossover frequency FC and the part of the transferred bone conduction sound signal BSTH that is lower than the crossover frequency FC are synthesized to generate the synthesized sound signal CST by the synthesis circuit 150.

It is appreciated that the embodiments described above are merely an example. In other embodiments, it should be appreciated that many modifications and changes may be made by those of ordinary skill in the art without departing, from the spirit of the invention.

In summary, the sound receiving apparatus and the sound receiving method of the present invention can dynamically adjust the crossover frequency that separates the frequency domains to combine the sound receiving results from the sound receiving circuits having different frequency characteristics. A better and strongly adaptive sound receiving result can be obtained.

The aforementioned descriptions represent merely the preferred embodiments of the present disclosure, without any intention to limit the scope of the present disclosure thereto. Various equivalent changes, alterations, or modifications based on the claims of present disclosure are all consequently viewed as being embraced by the scope of the present disclosure.

What is claimed is:

1. A sound receiving apparatus, comprising:

an air conduction sound receiving circuit configured to generate an air conduction sound signal according to a sound;

a bone conduction sound receiving circuit configured to generate a bone conduction sound signal according to the sound;

an adaptive filter configured to perform calculation according to a minimum of an error function in real time to generate a transferring filter function to filter the bone conduction sound signal and generate a transferred bone conduction sound signal, in which the error function is an error between the air conduction sound signal and the transferred bone conduction sound signal;

a crossover frequency control circuit configured to determine a crossover frequency according to a maximum energy frequency point of the transferring filter function on a frequency domain; and a synthesis circuit configured to synthesize a part of the air conduction sound signal that is higher than the crossover frequency and a part of the bone conduction sound signal that is lower than the crossover frequency to generate a synthesized sound signal.

2. The sound receiving apparatus of claim 1, wherein the synthesis circuit comprises:

a high pass filter configured to perform a high pass filtering on the air conduction sound signal according to a high frequency band higher than the crossover frequency to generate a first filtered result;

a low pass filter configured to perform a low pass filtering on the bone conduction sound signal according to a low frequency band lower than the crossover frequency to generate a second filtered result; and an adding circuit configured to add the first filtered result and the second filtered result to generate the synthesized sound signal.

3. The sound receiving apparatus of claim 1, wherein the error function is a least mean square error function and the transferring filter function is generated by a normalized least mean square (NLMS) algorithm.

4. The sound receiving apparatus of claim 1, wherein the crossover frequency control circuit is configured to determine the crossover frequency by performing a calculation on a frequency of the maximum energy frequency point by using at least one adjusting function and/or an average function.

5. The sound receiving apparatus of claim 1, further comprising:

a first time domain to frequency domain conversion circuit configured to perform a time domain to frequency domain conversion on the air conduction sound signal received by the air conduction sound receiving circuit; and a second time domain to frequency domain conversion circuit configured to perform a time domain to frequency domain conversion on the bone conduction sound signal received by the bone conduction sound receiving circuit;

wherein the adaptive filter and the crossover frequency control circuit operate on a frequency domain.

6. The sound receiving apparatus of claim 5, further comprising a pre-processing high pass filter configured to perform a high pass filtering on the bone conduction sound signal received by the bone conduction sound receiving circuit such that the second time domain to frequency domain conversion circuit performs the time domain to frequency domain conversion on the filtered bone conduction sound signal.

7. The sound receiving apparatus of claim 6, further comprising:

a first frequency domain to time domain conversion circuit configured to perform a frequency domain to time domain conversion on the air conduction sound signal converted to the frequency domain; and a second frequency domain to time domain conversion circuit configured to perform a frequency domain to time domain conversion on the bone conduction sound signal converted to the frequency domain;

wherein the synthesis circuit operates on a time domain.

8. The sound receiving apparatus of claim 6, further comprising:

a frequency domain to time domain conversion circuit configured to perform a frequency domain to time domain conversion on the synthesized sound signal, wherein the synthesis circuit operates on a frequency domain.

9. A sound receiving method used in a sound receiving apparatus, comprising:

generating an air conduction sound signal according to a sound by an air conduction sound receiving circuit;

generating a bone conduction sound signal according to the sound by a bone conduction sound receiving circuit;

performing calculation by an adaptive filter according to a minimum of an error function in real time to generate a transferring filter function to filter the bone conduction sound signal and generate a transferred bone conduction sound signal, in which the error function is an error between the air conduction sound signal and the transferred bone conduction sound signal;

determining a crossover frequency by a crossover frequency control circuit according to a maximum energy frequency point of the transferring filter function on a frequency domain; and synthesizing a part of the air conduction sound signal that is higher than the crossover frequency and a part of the bone conduction sound signal that is lower than the crossover frequency to generate a synthesized sound signal by a synthesis circuit.

10. The sound receiving method of claim 9, further comprising:

performing a high pass filtering on the air conduction sound signal according to a high frequency band higher than the crossover frequency to generate a first filtered result by a high pass filter of the synthesis circuit;

performing a low pass filtering on the bone conduction sound signal according to a low frequency band lower than the crossover frequency to generate a second filtered result by a low pass filter of the synthesis circuit; and adding the first filtered result and the second filtered result to generate the synthesized sound signal by an adding circuit of the synthesis circuit.

11. The sound receiving method of claim 9, wherein the error function is a least mean square error function and the transferring filter function is generated by a normalized least mean square (NLMS) algorithm.

12. The sound receiving method of claim 9, further comprising:

determining the crossover frequency by performing a calculation on a frequency of the maximum energy frequency point by using at least one adjusting function and/or an average function by the crossover frequency control circuit.

13. The sound receiving method of claim 9, further comprising:

performing a time domain to frequency domain conversion on the air conduction sound signal received by the air conduction sound receiving circuit by a first time domain to frequency domain conversion circuit; and performing a time domain to frequency domain conversion on the bone conduction sound signal received by the bone conduction sound receiving circuit by a second time domain to frequency domain conversion circuit;

wherein the adaptive filter and the crossover frequency control circuit operate on a frequency domain.

14. The sound receiving method of claim 13, further comprising:

performing a high pass filtering on the bone conduction sound signal received by the bone conduction sound receiving circuit by a pre-processing high pass filter; and performing the time domain to frequency domain conversion on the filtered bone conduction sound signal by the second time domain to frequency domain conversion circuit.

15. The sound receiving method of claim 14, further comprising:

performing a frequency domain to time domain conversion on the air conduction sound signal converted to the frequency domain by a first frequency domain to time domain conversion circuit; and performing a frequency domain to time domain conversion on the bone conduction sound signal converted to the frequency domain by a second frequency domain to time domain conversion circuit;

wherein the synthesis circuit operates on a time domain.

16. The sound receiving method of claim 14, further comprising:

performing a frequency domain to time domain conversion on the synthesized sound signal by a frequency domain to time domain conversion circuit, wherein the synthesis circuit operates on a frequency domain.

* * * * *